United States Patent [19]

Dörr

[11] Patent Number: 5,045,246

[45] Date of Patent: Sep. 3, 1991

[54] SUCTION DEVICE

[75] Inventor: Siegfried Dörr, Borken, Fed. Rep. of Germany

[73] Assignee: Pulmatec Holding, Inc., Zona, Panama

[21] Appl. No.: 614,955

[22] Filed: Nov. 15, 1990

Related U.S. Application Data

[63] Continuation of Ser. No. 78,365, Jul. 27, 1987, abandoned, which is a continuation-in-part of Ser. No. 694,461, Jan. 24, 1985, Pat. No. 4,685,444.

[30] Foreign Application Priority Data

Nov. 13, 1986 [CH] Switzerland ..... 4528/86

[51] Int. Cl.[5] ..... F04D 3/02

[52] U.S. Cl. ..... 261/93; 415/74; 415/143; 416/223 R

[58] Field of Search ..... 415/72-74, 415/143; 416/223 R; 261/93

[56] References Cited

U.S. PATENT DOCUMENTS

| | | | |
|---|---|---|---|
| 851,457 | 4/1907 | Verner | 416/223 R X |
| 1,765,338 | 6/1930 | Jones et al. | 210/26 |
| 1,921,220 | 8/1933 | Daman | 261/93 |
| 2,177,665 | 10/1939 | Loughrey | 202/30 |
| 2,333,497 | 11/1943 | Velander | 60/39.57 X |
| 2,878,644 | 3/1959 | Fenn | 60/39.57 |
| 2,902,029 | 9/1959 | Hill | 126/360 A |
| 3,278,170 | 10/1960 | Moritz | 261/29 |
| 3,438,722 | 4/1969 | Heredy et al. | 110/215 X |
| 3,568,658 | 3/1971 | Brock | 126/360 A |
| 3,647,358 | 3/1972 | Greenberg | 23/2 R |
| 3,756,171 | 9/1973 | DeBord | 110/215 |
| 3,984,001 | 10/1976 | Nagano et al. | 209/3 |
| 4,426,190 | 1/1984 | Shapiro et al. | 415/74 |
| 4,444,128 | 4/1984 | Monro | 110/345 |
| 4,637,779 | 1/1987 | Sherman et al. | 415/143 |

FOREIGN PATENT DOCUMENTS

| | | | |
|---|---|---|---|
| 570374 | 2/1959 | Canada | 415/143 |
| 576267 | 5/1924 | France | 415/143 |
| 56-34017 | 4/1981 | Japan | 110/215 |
| 57-14143 | 1/1982 | Japan | 126/360 A |
| 864 | of 1857 | United Kingdom | 415/74 |
| 759062 | 10/1956 | United Kingdom . | |

OTHER PUBLICATIONS

*Pump Handbook* by Karassik et al., ©1976 by McGraw-Hill Inc., N.Y.C., pp. 2-48-2-50.

*Primary Examiner*—Allen J. Flanigan
*Attorney, Agent, or Firm*—Pennie & Edmonds

[57] ABSTRACT

A novel turbine is described which consists of a disc or a shaft, to the upper and lower sides of which blades are attached, the blades on the upper side being at least three times larger than those on the underside. The combination of such a turbine with a guide tube provides a strong suction effect, which is suitable, for example, for drawing gases or gas/vapor mixtures into liquid media. Also, methods of directly heating a liquid by hot gases while avoiding the discharge of pollutants into the environment which comprises introducing the hot gases into the liquid with turbulence and with a suction effect such as, for example, by rotating the turbine in the liquid.

34 Claims, 2 Drawing Sheets

SUCTION DEVICE

CROSS REFERENCE TO RELATED APPLICATIONS

This is a continuation of application Ser. No. 07/078,365, filed July 27, 1987, now abandoned, which is a continuation-in-part of application Ser. No. 694,461, filed Jan. 24, 1985, now U.S. Pat. No. 4,685,444.

TECHNICAL FIELD

The present invention relates to a novel turbine which is suitable especially for whirling gases into liquid media, the term gases also comprising vapors, and liquid/gas mixtures.

SUMMARY OF THE INVENTION

The invention relates to an apparatus for the direct heating of a liquid by hot gases while avoiding the discharge of pollutants into the environment. This apparatus comprises means for holding a liquid containing an absorbent and including an out-flow opening for the introduction of hot gases into the liquid; burner means having a burning chamber situated outside the liquid in the holding means; elongated tubular means arranged within the holding means having a hot gas inlet and a hot gas outlet, the hot gas inlet being connected to the burner means and wherein at least the hot gas outlet of the tubular means extends into the liquid; and means located within the tubular means for generating a suction effect directed into the liquid, the suction effect means also effecting turbulent motion of the hot gases within the liquid for heating of the liquid and removal of pollutants by the absorbant.

The invention also relates to a turbine, a suction device, and methods of use thereof as more fully described in the detailed description hereinbelow.

BRIEF DESCRIPTION OF THE DRAWINGS

Further benefits and advantages of the invention will become apparent from a consideration of the following description given with reference to the accompanying drawings figures which specify and show preferred embodiments of the invention and wherein.

DESCRIPTION OF THE INVENTION

This invention is directed to an improvement of that disclosed in application Ser. No. 694,461, filed Jan. 24, 1985, now U.S. Pat. No. 4,685,444. To the extent necessary to understand or describe the present invention, the content of that application is expressly incorporated by reference herein.

Figure 1:
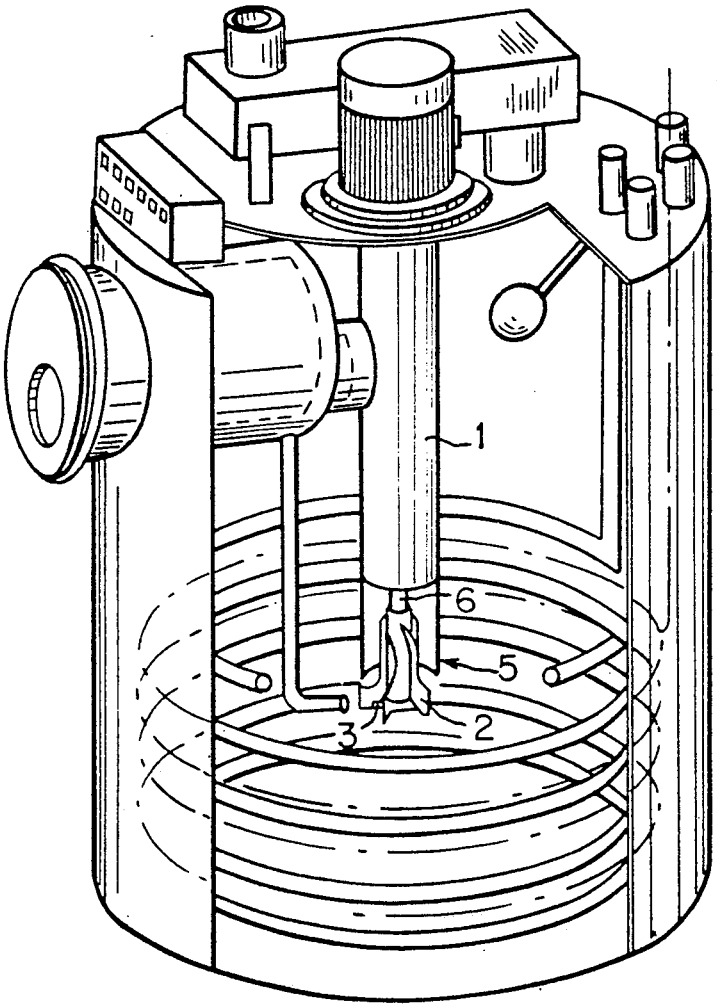
FIG. 1 is a perspective view of a suction device according to the invention with portions of the outer housing removed to illustrate the pump and disperser blades therein.

The present invention relates to a suction device of a type generally illustrated in FIG. 1, which includes a pump and disperser (5) combined with a guide tube (1). The features of this device are more specifically shown in FIGS. 2-4. The combination of the pump and disperser and guide tube makes it possible to draw gas mixtures or liquid/gas mixtures into liquid media. Due to the high suction force of the pump and disperser, the gas or liquid/gas mixture can also be drawn and whirled into the liquid medium even if the liquid medium is heated, it being possible in an extreme case for the liquid medium to be heated to its boiling point.

In detail, the pump and disperser according to the invention includes a disc (3), having lower and upper sides to which blades (2) are attached, and is characterized in that the blades on the upper side are at least three times larger than the blades on the underside in area. It is possible for the disc to be compact or also for segments (4) to be cut out this disc, if desired.

In a preferred embodiment of the pump and disperser, the blades on the upper side (2*a*) are curved. In a particularly preferred embodiment, the blades on the upper side of the disc have an S-shaped or half-helix curvature or form.

The disc (3) preferably has a height (thickness) of 0.1 to 4 cm. Advantageously, the height of the disc depends on its diameter and the size of the blades, these dimensions in turn being related to the desired power of the pump and disperser. Thus, the higher the suction power of the pump and disperser, the greater is the diameter of the disc, the higher (thicker) is the disc and, as a rule, more sharply curved are the blades on the upper side of the disc. The sizing in an individual case depends on the required constructional principle, which in turn depends on the field of use. The material used also has likewise a substantial influence on the proportions in sizing. The diameter of the disc depends advantageously on the speed of rotation, a smaller diameter requiring a high speed of rotation, and vice versa. In a preferred embodiment, the diameter of the disc is 8 to 12 cm, preferably 9 to 11 cm and more preferably 10 to 11 cm.

In such a preferred embodiment, the area of the blades on the lower side (2*b*) of the disc is 1 to 3 $cm^2$ and, correspondingly, the area of the blades on the upper side is 3 to 20 $cm^2$, provided that the area of each lower blade is at least 3 times that of the corresponding upper blade. These preferred dimensions can be multiplied with a factor for the case where, because of specific technical conditions and problems, higher or lower power of the pump and disperser is required. Segments can be cut out of the disc, whereby the disc becomes lighter but the suction effect of the pump and disperser is not substantially affected. Thus, any segment cut-out sizes (4) are possible between the extreme cases, on the one hand, of the compact disc and, on the other hand, fixing of the blades directly to the shaft (6), which rotates the pump and disperser, that is to say the largest segment cut-outs which are possible in view of the size (in FIG. 4, the segment (4) is completely absent in the extreme case).

The chosen form of the pump and disperser in a special case depends on the nature of the gas or vapor or the mixture of the two and on the nature of the liquid medium into which the gas or gas/vapor mixture is to be whirled.

If, for example, a flue gas is whirled or drawn into water, which, if appropriate, can also contain additives for absorbing constituents of the flue gas, such as alkali or alkaline compounds or the like, a pump and disperser embodiment is preferred in which the blades on the upper side of the disc have an S-shaped or half-helix form. If the water is to be heated by the flue gas, the flue gas above the pump and disperser consists of a mixture of gas and steam, as a function of the temperature (and the vapor pressure of the water with the additive). These conditions, as explained above taking flue gas and water as an example, are also applicable to other types of gases and liquid media, if these are heated. The conditions become particularly extreme if the liquid medium is heated almost or even fully up to the boiling point. Analogous conditions apply in the case of operation under a reduced pressure (i.e. in vacuo) or under an elevated pressure, especially when a compressor or axial compressor is used, that is to say the gas is first compressed and then forced in to the pump and disperser.

The pump and disperser runs with particularly high efficiency if it is combined with a guide tube. The invention thus also relates to a suction device which is characterized in that the pump and disperser (5) described above is combined with a guide tube (1).

Figure 2:
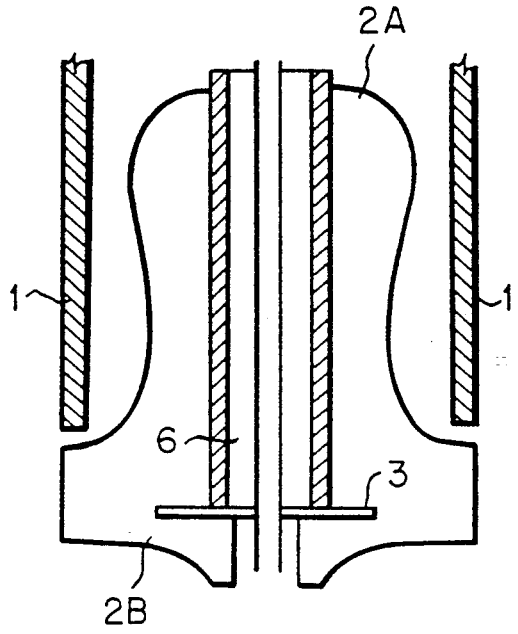
FIG.2 is a partial cross-sectional view of the pump and disperser blades and guide tube of the apparatus.
Figure 3:
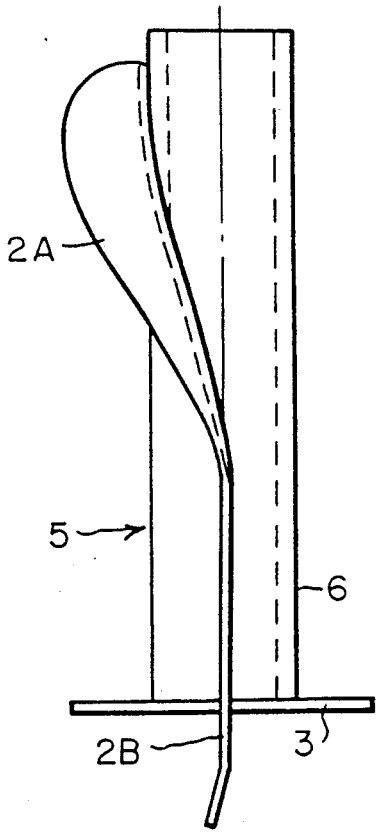
FIG. 3 is a side view of a pump and disperser blade to illustrate its shape and configuration.
Figure 4:
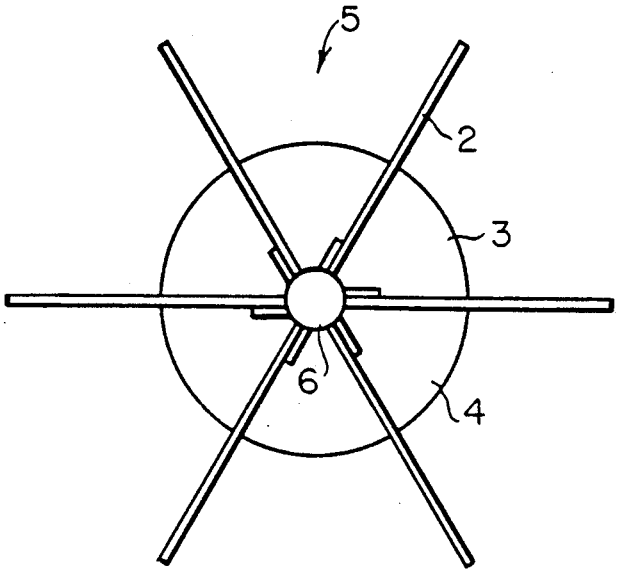
FIG. 4 is an end view of the pump and disperser blades and guide tube of FIG. 2.

In a preferred embodiment of the suction device; the blades (2) are located on the upper side of the disc (3) within the guide tube (1) as shown in FIGS. 2–4. The minimum distance of the blades (2) within the guide tube (1) from the inner edge of the guide tube is between 0.5 and 1.5 cm, preferably 0.8 to 1.2 cm. An embodiment is also preferred in which the lower edge of the guide tube ends flush with the pump and disperser and the dimension of the disc is only $\frac{2}{3}$ of the diameter of the guide tube. An arrangement is also preferred in which the lower edge of the disc is at the same height as the lower edge of the guide tube and the diameter of the disc is 50% to 80% of the diameter of the guide tube.

An embodiment is particularly preferred in which that part of the blades fixed to the upper side which is arranged nearest to the disc ends at a right angle flush or even with the lower edge of the guide tube or protrudes by a maximum of 2 cm, preferably 1 cm and most preferably 1 mm, beyond the latter. The number of blades on the upper side of the disc is at least 3, preferably a multiple of 3, particularly preferably 6 to 12 and with a very particular preference being 6 blades. The same applies to the number of blades on the underside of the lower end of the pump and disperser. However, other numbers are also possible, if desired.

The diameter of the guide tube is 7 to 12 cm, preferably 8 to 11 cm and particularly preferably 10 cm, for drawing in relatively small gas rates. These guide tube dimensions allow 30 to 80 $m^3$ of gas per hour to be whirled or sucked into the tube: If, for example, air is drawn into water, the output of such a suction device at a water temperature of 20° C. is about 70 to 120 $m^3$ of air per hour and sometimes higher. This applies to a gas temperature of 100° C. or higher. If the water is heated to 80° to 90° C., the output of the suction device at, for example, a diameter of the guide tube of 10 cm in a preferred embodiment of the pump and disperser is still approximately 40 $m^3$ of gas per hour or possibly higher. The drop in the pump and disperser output is a consequence of the evaporation of water, so that, at these high temperatures of the liquid medium, pump and disperser must also additionally draw steam into the liquid medium. The suction device is thus suitable for drawing gases into cold or hot liquid media, the gases simultaneously also being dispersed in an optimum manner in the liquid medium. The output of the pump and disperser is substantially affected by the flow velocity, with a preferred flow velocity being 12–14 meters per second.

The suction device is thus suitable, for example, for drawing flue gases into liquid media with simultaneous dispersion, so that the hot flue gases release their heat to the liquid medium in an optimum manner. An example of a preferred use of such a suction device is in heating technology, especially in low-temperature absorption heaters, as shown in FIG. 1. This suction device is also suitable for drawing biogases from, for example, effluent treatment plants into an absorption liquid, whereby pollutants such as hydrogen sulphide, hydrogen chloride and the like are eliminated. The purified biogas can then be used further for other applications. The same device can be used for aerating effluent treatment plants. Such suction devices have hitherto not been used in technology, so that no theoretical knowledge whatsoever exists.

The invention also relates to a process for drawing gases into liquid media, which is characterized in that the pump and disperser and/or suction device described above is used.

While it is apparent that the invention herein disclosed is well calculated to fulfill the desired results, it will be appreciate that numerous modifications and embodiments may be devised by those skilled in the art, and it is intended that the appended claims cover all such modifications and embodiments as fall within the true spirit and scope of the present invention.

What is claimed is:

1. A pump and disperser for the aspiration of a gas into a liquid comprising a rotatable member having attached thereto with respect to a common horizontal plane, a plurality of upper and lower blades; wherein the active surface area of the upper blades is at least three times larger than that of the lower blades, and each of the upper blades is wider at its top than at its bottom and is curved in the form of a half-helix extending longitudinally along the rotatable member and helically therearound.

2. The pump and disperser as claimed in claim 1, wherein the rotatable member is a shaft.

3. The pump and disperser as claimed in claim 1, wherein the rotatable member is compact disc means.

4. The pump and disperser as claimed in claim 1, wherein the curvature of the upper blades follows an S-shape.

5. The pump and disperser as claimed in claim 1, wherein the number of upper and lower blades is six each.

6. A suction device comprising a pump and disperser according to claim 1 combined and operatively associated with guide tube means.

7. The suction device as claimed in claim 6, wherein the outer edge of each lower blade is rectangular and is substantially flush with the outer diameter of the guide tube means.

8. The suction device as claimed in claim 6, wherein the lower blades are rectangular and protrude by at least 1 mm beyond the lower end of the guide tube means.

9. The pump and disperser as claimed in claim 1, wherein the rotatable member is segmented disc means.

10. The suction device as claimed in claim 6, wherein the lower portion of each blade extends beyond the bottom of the guide tube means and has outer edges extending to the outer diameter of the guide tube means.

11. A pump and disperser for the aspiration of a gas into a liquid comprising a substantially vertical rotatable shaft having attached thereto with respect to a common horizontal plane, at least six upper blades and six lower blades; wherein the active surface area of the upper blades is at least three times larger than that of the lower blades, and each of the upper blades is wider at its top than at its bottom and is curved in the form of a half-helix, extending longitudinally along the rotatable member and helically therearound.

12. The pump and disperser as claimed in claim 11, wherein the curvature of the upper blades follows an S-shape.

13. A suction device comprising a pump and disperser according to claim 11 combined and operatively associated with guide tube means.

14. The suction device as claimed in claim 13, wherein the outer edge of each lower blade is rectangular and is substantially flush with the outer diameter of the guide tube means.

15. The suction device as claimed in claim 13, wherein the lower blades are rectangular and protrude by at least 1 mm beyond the lower end of the guide tube means.

16. The suction device as claimed in claim 13, wherein the lower portion of each blade extends beyond the bottom of the guide tube means and has outer edges extending to the outer diameter of the guide tube means.

17. A pump and disperser for the aspiration of a gas into a liquid comprising a rotatable disc member having attached thereto, a plurality of upper and lower blades; wherein the active surface area of the upper blades is at least three times larger than that of the lower blades, and each of the upper blades is wider at its top than at its bottom and is curved in the form of a half-helix extending longitudinally along the rotatable member and helically therearound.

18. The pump and disperser as claimed in claim 17, wherein the disc member is segmented.

19. The pump and disperser as claimed in claim 17, wherein the curvature of the upper blades follows an S-shape.

20. The pump and disperser as claimed in claim 17, wherein the number of upper and lower blades are six each.

21. A suction device comprising a pump and disperser according to claim 17 combined and operatively associated with guide tube means.

22. The suction device as claimed in claim 21, wherein the outer edge of each lower blade is rectangular and is substantially flush with the outer diameter of the guide tube means.

23. The suction device as claimed in claim 17, wherein the lower blades are rectangular and protrude by at least 1 mm beyond the lower end of the guide tube means.

24. The suction device as claimed in claim 21, wherein the lower portion of each blade extends beyond the bottom of the guide tube means and has outer edges extending to the outer diameter of the guide tube means.

25. A suction device for exchanging heat between a gas and a liquid and for removing pollutants from the gas, comprising:

a) a container for holding liquid;

b) a guide tube by which a flow of gas may be directed to the liquid;

c) a rotatable member disposed through the guide tube and having a plurality of blades for forcing gas into the liquid, each of said blades having an upper portion and a lower portion wherein the upper portion is curved in the form of a half helix and extends longitudinally along the rotatable member and wraps helically around the rotatable member, said upper portion being wider at its top than at its bottom, and the lower portion of each blade extends beyond the bottom of the guide tube and has outer edges extending to the outer diameter of the guide tube, and the active surface area of the upper portion of each blade is at least three times larger than that of the lower portion of each blade.

26. The suction device as claimed in claim 25, wherein the upper portion of each blade has a smoothly curved shape, and wherein the lower portion of each blade has a straight outer edge and a section of the lower portion along the bottom edge is angled in a direction adapted to partially obstruct the flow which the upper portion creates, so that gas is turbulently dispersed into the liquid.

27. The suction device as claimed in claim 26, wherein the minimum distance of the upper portion of each blade within the guide tube from the inner edge of the guide tube is from about 0.8 to 1.2 cm.

28. The suction device as claimed in claim 27, wherein each blade is arranged so that the bottom of the upper portion protrudes no more than about 2 cm beyond the end of the guide tube.

29. The suction device as claimed in claim 25, further comprising a disc mounted on the rotatable member and at least partially separating the upper and lower portions of the blades.

30. The suction device as claimed in claim 29, wherein the diameter of the disc is about 50% to 80% of the diameter of the guide tube.

31. The suction device as claimed in claim 29, wherein the disc has a height of about 0.1 to 4 cm.

32. The pump and disperser as claimed in claim 8 wherein the lower blades are substantially rectangular and extend radially from the rotatable member.

33. The pump and disperser as claimed in claim 11 wherein the lower blades are substantially rectangular and extend radially from the rotatable member.

34. The pump and disperser as claimed in claim 17 wherein the lower blades are substantially rectangular and extend radially from the rotatable member.

* * * * *